US008651030B2

(12) United States Patent
Coffman

(10) Patent No.: US 8,651,030 B2
(45) Date of Patent: Feb. 18, 2014

(54) UNIVERSAL PORTABLE WORKSTATION

(75) Inventor: Zachary M. Coffman, Shawnee, KS (US)

(73) Assignee: mYdeation, llc, Shawnee, KS (US)

( * ) Notice: Subject to any disclaimer, the term of this patent is extended or adjusted under 35 U.S.C. 154(b) by 0 days.

(21) Appl. No.: 13/083,223

(22) Filed: Apr. 8, 2011

(65) Prior Publication Data

US 2011/0247530 A1 Oct. 13, 2011

Related U.S. Application Data

(60) Provisional application No. 61/322,182, filed on Apr. 8, 2010, provisional application No. 61/322,434, filed on Apr. 9, 2010.

(51) Int. Cl.
*A47B 57/00* (2006.01)

(52) U.S. Cl.
USPC ..... 108/97; 108/42; 108/169

(58) Field of Classification Search
USPC ..... 108/42, 44, 47, 48, 65, 169, 147.17, 108/147.18, 138.13, 97, 158.13, 117, 121, 108/123, 125, 130, 131
See application file for complete search history.

(56) References Cited

U.S. PATENT DOCUMENTS

| | | | | |
|---|---|---|---|---|
| 152,777 | A * | 7/1874 | Strickler | 108/97 |
| 5,205,222 | A * | 4/1993 | Bernard | 108/97 |
| 5,320,049 | A * | 6/1994 | Rowland | 108/150 |
| 5,713,404 | A | 2/1998 | Ladewig | |
| 5,730,066 | A * | 3/1998 | Auten et al. | 108/44 |
| 5,918,550 | A * | 7/1999 | Weir et al. | 108/42 |
| 6,045,172 | A * | 4/2000 | Thomas et al. | 296/26.1 |
| 6,047,750 | A | 4/2000 | Jensen | |
| 6,193,294 | B1 * | 2/2001 | Disner et al. | 296/26.11 |
| 6,308,643 | B1 * | 10/2001 | Cummings | 108/69 |
| 6,705,234 | B1 * | 3/2004 | Miller et al. | 108/36 |
| D489,557 | S | 5/2004 | Strong et al. | |
| 6,739,269 | B1 * | 5/2004 | Benton | 108/44 |
| 6,984,066 | B2 * | 1/2006 | Borom | 378/209 |
| 7,044,068 | B2 | 5/2006 | Stanford | |
| 7,069,865 | B2 | 7/2006 | Strong et al. | |
| 7,171,910 | B2 | 2/2007 | Neunzert et al. | |
| 7,229,128 | B2 * | 6/2007 | Lee | 297/16.2 |
| 7,231,676 | B2 * | 6/2007 | Cloer et al. | 5/310 |
| 7,424,833 | B2 * | 9/2008 | Fich et al. | 74/89.35 |
| 7,475,644 | B2 | 1/2009 | Strong et al. | |

(Continued)

FOREIGN PATENT DOCUMENTS

| | | | |
|---|---|---|---|
| JP | 3141187 | B2 | 3/2001 |
| KR | 100637698 | B1 | 10/2006 |

*Primary Examiner* — Daniel Rohrhoff
(74) *Attorney, Agent, or Firm* — Husch Blackwell LLP

(57) ABSTRACT

A universal portable workstation that can be temporarily coupled to an existing fixture, the portable workstation comprising an adjustable support leg assembly, a first table section, a second table section and an attachment clamp. The support leg assembly includes one fixed leg and at least one adjustable leg configured for relative telescopic movement. The support leg assembly is pivotally coupled to a first table section that is configured to house the support leg assembly in a retracted position. The height of the workstation is adjustable and can be fixed by a height adjustment lock. First table section and second table section are hingedly coupled so that the two sections can be in an extended, flat position and a folded, retracted position. The attachment clamp is configured to temporarily fixedly couple an end of the second table section to the existing fixture.

19 Claims, 7 Drawing Sheets

(56) References Cited

U.S. PATENT DOCUMENTS

| | | | | |
|---|---|---|---|---|
| 7,628,439 | B1 * | 12/2009 | Strong | 296/26.03 |
| 7,634,970 | B2 | 12/2009 | Strong et al. | |
| 7,814,844 | B2 | 10/2010 | Haney et al. | |
| 2005/0022701 | A1 * | 2/2005 | Choi et al. | 108/131 |
| 2005/0034783 | A1 | 2/2005 | Laird | |
| 2005/0274302 | A1 * | 12/2005 | Jin et al. | 108/126 |
| 2009/0145342 | A1 * | 6/2009 | Flanet | 108/147.19 |
| 2009/0241811 | A1 * | 10/2009 | Markegard et al. | 108/118 |
| 2009/0249985 | A1 * | 10/2009 | Dubois et al. | 108/55.5 |
| 2011/0247530 | A1 * | 10/2011 | Coffman | 108/116 |

* cited by examiner

UNIVERSAL PORTABLE WORKSTATION

CROSS-REFERENCE TO RELATED APPLICATIONS

This application claims the benefit of U.S. Provisional Patent Application No. 61/322,182 having a filing date of Apr. 8, 2010 and U.S. Provisional Patent Application No. 61/322,434 having a filing date of Apr. 9, 2010 both of which are incorporated herein by reference to the extent permitted by law.

BACKGROUND OF THE INVENTION

Many people in the world live in apartments, houses, or dorm rooms that have small kitchens with limited (or no) countertops or work surfaces. Further, many people participate in recreational activities in places with confined spaces and limited workspace such as recreational vehicles, boats, campsites, tail gate parties, barbecues, or the like. Often these locations have an inadequate area of workspace or countertop space, if any. Since people also like to combine meals and food while living or participating in a recreational activity, at times of food preparation or presentation, there is a need to temporarily increase the area of workspace or countertop space. It is desirable that these temporary portable workspaces are removable and allow for easy storage when the table top is not needed. People have use folding tables for many years for this particular purpose.

Folding card tables are portable, but often bulky as they include a solid one-piece table surface. Thus, to store and transport a workspace or table four feet long, one requires a location in a car or other transportation method that has a continuous area of four feet long. This is often difficult to find in any mode of transportation. Further, folding tables have a fixed table height and, therefore, if one desires to have a workspace or countertop extension at one height, they are bound by the fixed height of a folding card table. Having a work surface of uniform height is advantageous for a variety of reasons, including having a universal portable workstation that may be used in a variety of applications as a temporary work surface extension that matches the height of the existing work surface at that location. For example, one portable workstation that is able to provide a temporary extension of a desk at a height of twenty-nine inches (29") above the floor in an office, and also be used to provide a temporary work surface at counter height of thirty six inches (36"). The temporary tables in the prior art with fixed length legs may only match one of these heights, if any, and only if the heights matched by chance. Thus, there is a need in the art for a portable workstation having an adjustable height to match the height of a plurality known work spaces.

Further, existing portable tables do not attach to the existing surface, so there is always some discontinuity or a joint where items may fall through. Thus, another need exists for a temporary, portable workstation that can attach to an existing fixture to provide some continuity between the two surfaces.

BRIEF SUMMARY OF THE INVENTION

The present invention is directed to a universal portable workstation that is intended to provide extra work or counter space wherever needed in a home, commercial or industrial setting, boat, recreational vehicle, or attached to a picnic or patio table, barbeque grill, bar, tailgate, or any other surface. The portable workstation of the present invention comprises a foldable work surface, at least one adjustable leg, and an attachment clamp. The portable workstation of the present invention may also include a handle and a second adjustable leg that may be used to provide a stand-alone table.

The work surface of the portable workstation comprises a first table section and a second table section that are pivotally coupled by a hinge or other like coupling mechanism. In one embodiment, the hinge is separable to allow for the first section and second section to be separated and used individually. In another embodiment, the hinge or other like coupling mechanism may include a locking mechanism that temporarily fixes the two table sections together and prevents them from collapsing. The main structure of the portable workstation consists of two table sections that include a substantially flat working surface wherein the two sections fold together to provide a low profile ideal for storage and transport. The two table sections of the work surface of the portable workstation may be of extruded, injected, or molded composite material, or alternatively may be flat panels, such as plywood, sheet metal, or sheet plastic on top of a frame substructure.

The adjustable support leg comprises an arrangement of one or more telescoping legs. One leg section is fixed and pivotally coupled to the bottom of the work surface. One or more slideable legs are then telescopically coupled with the fixed legs. The combined height of the fixed portion and at least one slideable leg is set as desired and the relative position of the two legs is fixed using a height adjustment lock. One embodiment of the slideable leg includes one or more tubular legs telescopingly engaged with a singular fixed tubular section that is pivotally coupled to an end of the portable workstation. An alternative embodiment of the slideable leg includes two tubular legs with a brace between the two legs to brace and stabilize the legs and the portable workstation.

The portable workstation of the present invention may also include one or more attachment clamps that couples one end of the workstation to an existing work surface. Existing work surfaces that may support the portable workstation of the present invention are countertops, tables, bars, desks, tailgates, railings, ledges, or any other work surfaces. The attachment clamp(s) may be hooks, straps, elastic cords, clamps, hook and loop fastener (VELCRO®), or any combination thereof or any other attachment methods now known or hereafter developed. The attachment clamp(s) of the present invention allows a user to develop some continuity between the existing work surface and the temporary, portable workstation of the present invention.

The adjustable support legs and the attachment clamp(s) are configured to be pivoted and housed within the depth of the workstation. Thus, the portable workstation of the present invention may be folded up for transportation and/or flat storage. For example, the portable workstation of the present invention may be stored behind a couch in a recreational vehicle or under the seat on a boat until it is needed. A user will un-fold the two sections, rest the notched end of the workstation on top of the existing work surface, and adjust the height of the adjustable support leg to substantially match the existing work surface. Finally, the user will secure the notched end of the work surface using the attachment clamp (s).

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 1:
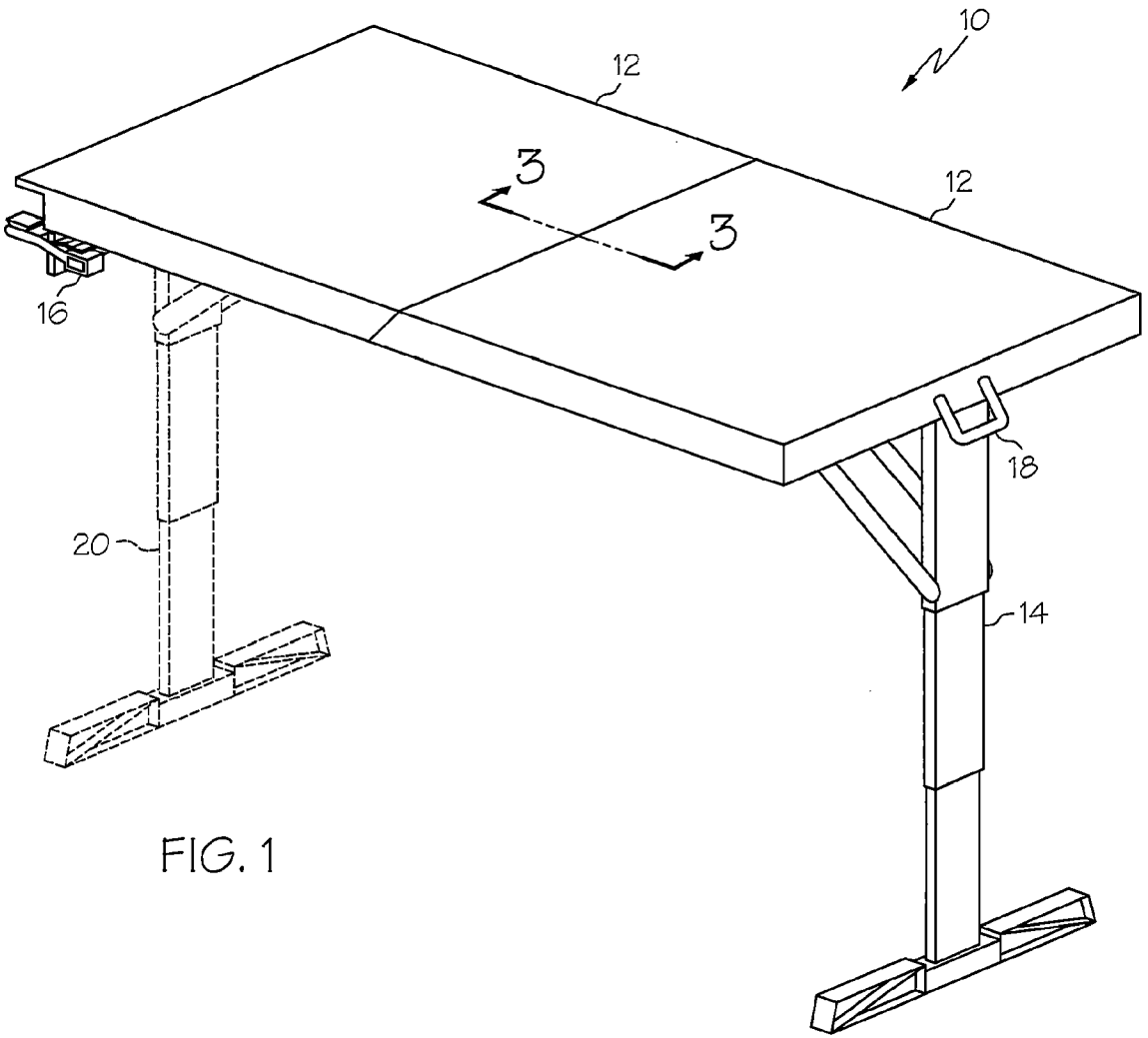
FIG. 1 is a perspective view of one embodiment of a universal portable workstation in accordance with the teachings of the present invention.

FIG. 1 illustrates an embodiment of portable workstation 10 of the present invention. Portable workstation 10 comprises a work surface 12, at least one adjustable support leg 14, and an attachment clamp 16. Portable workstation 10 may also include a handle 18 and a second adjustable support leg 20. Handle 18 may be slideably coupled to work surface 12 and configured to be stored in a retracted position flush with a side or an end of work surface 12 and able to be pulled out for transport. Further, handle 18 may include a pop-out mechanism that pops handle 18 out from its flush position for transport. Attachment clamp 16 temporarily attaches portable workstation 10 to a countertop, table, bar, desk, tailgate, or other work surfaces, ledges, or railings.

Figure 2:
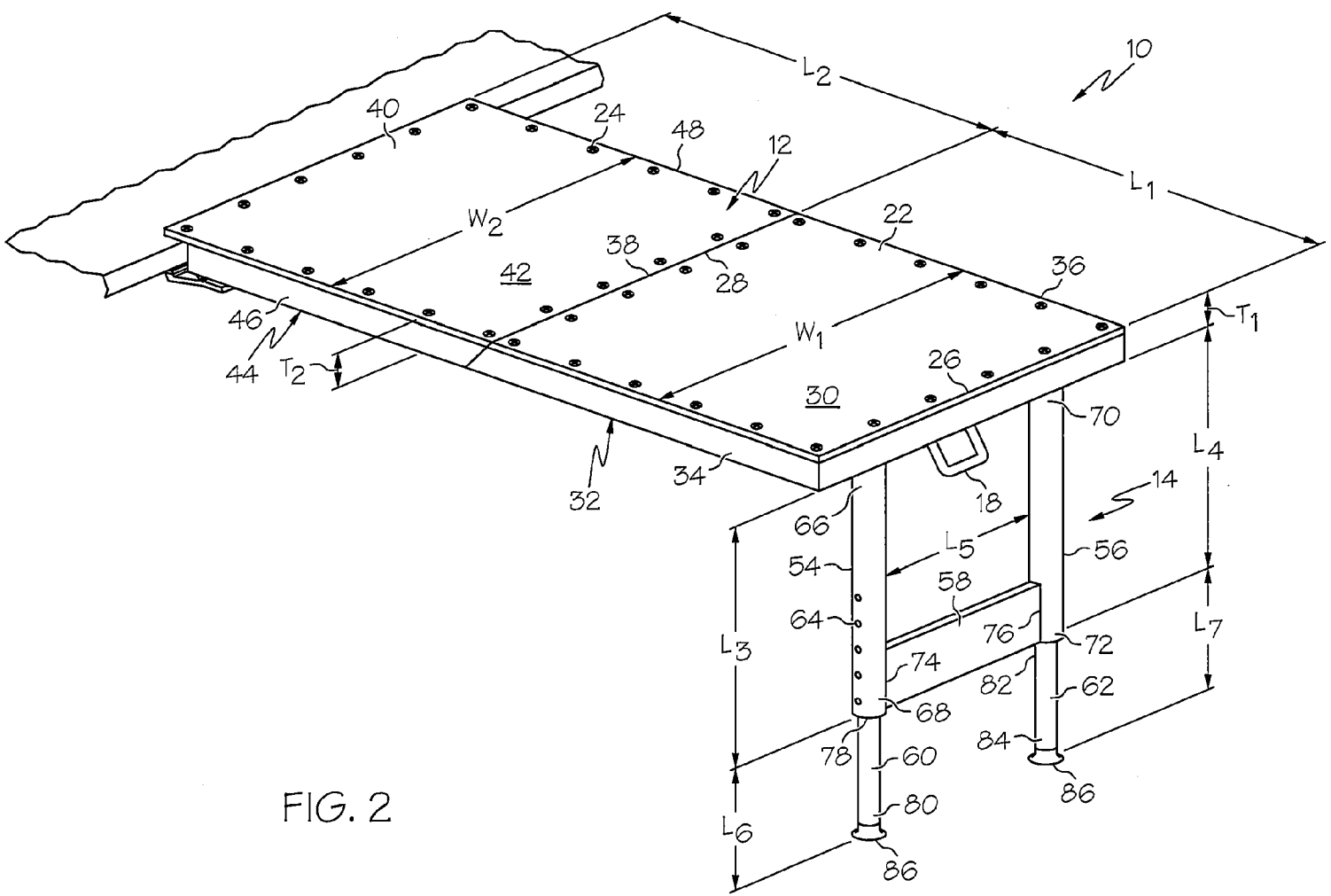
FIG. 2 is a perspective view of another embodiment of a universal workstation in accordance with the teachings of the present invention.

Now turning to FIG. 2, work surface 12 comprises a first table section 22 and a second table section 24. First table section 22 includes a first end 26, a second end 28, a top surface 30, a bottom surface 32, a first side 34, a second side 36 and a thickness $T_1$. First table section 22 may have a substantially uniform thickness or the thickness may vary at different locations of first table section 22. Thickness $T_1$ may range from about one-half inch (½") to about four inches (4"). One embodiment of first table section 22 includes a thickness $T_1$ in a range from about one and three-quarters inches (1¾") to two and one-half inches (2½").

One embodiment of portable workstation 10 includes first table section 22 having a substantially rectangular shape as shown in FIG. 2. Alternatively, portable workstation 10 may include first table section 22 having a substantially trapezoidal, circular, or oval shape. First table section 22 includes a width $W_1$ and a length $L_1$. Width $W_1$ is in a range from about twelve inches (12") to about forty inches (40"). One embodiment includes first table section 22 having a width $W_1$ of about eighteen inches (18"). Length $L_1$ is in a range from about twelve inches (12") to about thirty six inches (36"). One embodiment of portable workstation 10 includes first table section 22 having a length $L_1$ of about twenty inches (20").

Second table section 24 includes a first end 38, a second end 40, a top surface 42, a bottom surface 44, a first side 46, a second side 48 and a thickness $T_2$. Second table section 24 may have a substantially uniform thickness or the thickness may vary at different locations of second table section 24. Thickness $T_2$ may range from about one-half inch (½") to about four inches (4"). One embodiment of second table section 24 includes a thickness $T_2$ of one and three-quarters inches (1¾") to two and one-half inches (2½"). The thickness $T_1$ of first table section 22 may be substantially equal to thickness $T_2$ of second table section 24 when the thicknesses are uniform. If an embodiment includes the thickness of table sections 22 and 24 varying along length $L_1$ and $L_2$ or width $W_1$ and $W_2$, then the thicknesses may be configured to mirror each other to provide a uniform appearance when portable workstation 10 is folded for transport or storage. The principle of the invention, however, is not dependent upon thicknesses $T_1$ and $T_2$ and, as such, a person of skill in the art will appreciate that thickness $T_1$ and $T_2$ as described herein shall not be limiting.

One embodiment of portable workstation 10 includes second table section 24 having a substantially rectangular shape as shown in FIG. 2. Alternatively, portable workstation 10 may include second table section 24 having a substantially trapezoidal, circular, or oval shape. Second table section 24 includes a width $W_2$ and a length $L_2$. Width $W_2$ ranges from about twelve inches (12") to about forty inches (40"). One embodiment includes first table section 22 having a width $W_2$ of about eighteen inches (18"). Length $L_2$ ranges from about twelve inches (12") to about thirty six inches (36"). One embodiment includes first table section 22 having a length $L_2$ of about twenty inches (20"). Second table section 24 may have a substantially identical or complementary shape to first table section 22.

Lengths $L_1$ and $L_2$ and widths $W_1$ and $W_2$ may be uniform and thereby define a rectangular shape, or they may vary to define a trapezoidal or other irregular shape. Some embodiments of portable workstation 10 may include a portion of first end 26 or second end 40 being inwardly recessed, outwardly extending, or a combination thereof. Another embodiment of portable workstation 10 may include a portion of first side 34, second side 36, first side 46, and/or second side 48 being inwardly recessed or outwardly extending and table sections 22 and 24 and may include a width that varies along the table section's length.

Work surface 12 may be made of any material known in the art including, but not limited to: UHMW polyethylene, lowdensity polyethylene, high-density polyethylene, wood, aluminum, steel, brass, copper, glass, composite polymer materials or any other suitable material now known or hereafter discovered. Work surface 12 may comprise a frame supporting a top surface panel or, alternatively, may be of unitary construction. The machining may be done manually, or may be performed by any automatic machining system known in the art. Automatic manufacturing may be performed in a CAD/CAM system. An alternative method of manufacture includes injection molding, compression molding, resin transfer molding, transfer molding of composite materials or metals, and any other molding method know in the art. In addition to the methods identified above, work surface 12 may be manufactured using any manufacturing method now known or hereafter developed that is capable of creating work surface 12 as described herein.

An embodiment shown in FIG. 2 includes a work surface 12 being natural or manufactured wood sheathing, sheet metal or a polymeric sheet coupled to a frame constructed of solid or tubular members of metal, polymeric material, or wood wherein the frame members have either a substantially rectangular or substantially round cross-section. The frame may be configured to substantially match the extents of work surface 12 and the frame of tube members may define a cavity that is configured to receive adjustable support leg 14 in a folded position. One embodiment includes a frame constructed of extruded aluminum tube members, powder coated tubular steel, or combination thereof. Coupling of the top surface to the frame or any other coupling of members of the present invention may be achieved through any coupling method now known or hereafter developed, including: nails, screws, pins, rivets, welds, bolts, clamps, adhesives, and/or straps.

In the embodiment shown in FIG. 2, adjustable support leg assembly 14 includes a first fixed leg 54, a second fixed leg 56, a brace 58, a first adjustable leg 60, a second adjustable leg 62, and a height adjustment lock 64. First fixed leg 54 includes a first end 66, a second end 68 and a length $L_3$. Second fixed leg 56 similarly includes first end 70, a second end 72, and a length $L_4$. First and second fixed legs 54 and 56 are of similar shape and length. First and second fixed legs 54 and 56 have a rectangular or circular hollow cross-section, but any shape known in the art is within the scope of the present invention. A hollow cross-section includes an outer dimension, an inner dimension, and a wall thickness. The difference between the outer dimension and the inner dimension is the wall thickness. The outer dimension of the cross-section of first and second fixed legs 54 and 56 is preferably less than thickness $T_1$ or $T_2$ of work surface 12. However, an outer dimension of first and second fixed legs 54 and 56 being greater than $T_1$ or $T_2$ is within the scope of the present invention.

Brace 58 includes a first end 74, a second end 76, and a length $L_5$. Brace 58 is configured between said first and second fixed legs 54 and 56 to connect fixed legs 54 and 56. As shown in FIG. 2, first end 74 of brace 58 is coupled to the first fixed leg 54 proximate the second end 68 and second end 76 of brace 58 is coupled to second fixed leg 56 proximate second end 72. An embodiment of the portable workstation of the present invention includes brace 58 being positioned substantially perpendicular to fixed legs 54 and 56 as shown. An alternative embodiment (not shown) may include one or more brace 58 being coupled to first fixed leg 54 and second fixed leg 56 in an angular orientation or trussed configuration.

First adjustable leg 60 includes a first end 78, a second end 80 and a length $L_6$. Second adjustable leg 62 similarly includes first end 82, a second end 84, and a length $L_7$. Second ends 80 and 84 may further include a shoe 86 that is coupled to second ends 80 and 84 as shown in FIG. 2. Shoe 86 may be any element now known or hereafter discovered that prevents second ends 80 and 84 from marking or damaging a floor, ground, or other support surface and/or increases the friction between the support surface and adjustable support leg assembly 14. Shoe 86 may be rubber or a soft polymer and may slide over or otherwise be coupled to second ends 80 and 84. Shoe 86 may also comprise or include one or more threaded levelers that are operably connected to ends 80 and 84 such that they may be rotated relative to ends 80 and 84 to fine tune the height and level work surface 12 of portable workstation 10. The threaded leveler may be threaded screws that have a non-abrasive and/or not marking finish such that they will not indent or mark the supporting surface. Work surface 12 may include a level indicator (not shown) coupled thereto.

First and second adjustable legs 60 and 62 may have a rectangular or circular cross-section and may be hollow or solid. However, any shape known in the art is within the scope of the present invention. The outer dimension of the cross-section of first and second adjustable legs 60 and 62 is less than the inner dimension of the hollow cross-section of first and second fixed legs 54 and 56 such that first end 78 of adjustable leg 60 is received into and slideably engages second end 68 of first fixed leg 54 and first end 82 of adjustable 62 is received into and slideably engages second end 72 of second fixed leg 56.

An alternative embodiment of the present invention is substantially similar to that described above, but a tubular cross section of adjustment legs 60 and 62 is such that the inner dimension of adjustment legs 60 and 62 is greater than the outer dimension of solid or tubular fixed legs 54 and 56 such that adjustment legs 60 and 62 slide over fixed legs 54 and 56. In such an embodiment, brace 58 may be coupled to adjustment legs 60 and 62 instead of fixed legs 54 and 56 as shown.

Adjustable legs 60 and 62 are temporarily fixed with respect to fixed legs 54 and 56 using height adjustment lock 64. Adjustable legs 60 and 62 may be individually adjusted to provide portable workstation to be substantially level even when the ground or other support surface is not level. As shown in FIG. 2, one embodiment includes adjustment legs 60 and 62 slideably received by fixed legs 54 and 56 thereby allowing a user to adjust the overall height of the adjustable support leg assembly 14 by sliding adjustment legs 60 and 62 within fixed legs 54 and 56. Adjustable legs 60 and 62 may be positioned in a fully retracted position within fixed legs 54 and 56 wherein the resulting $L_6$ and $L_7$ range from about zero inches (0") to about four inches (4"). Adjustable legs 60 and 62 may be extended to a desired length to provide an overall height of adjustable support leg assembly 14. The overall height of adjustable support leg assembly 14 corresponds to the sum of $L_3$ plus $L_6$ or $L_4$ plus $L_7$ as shown. In general the overall height of adjustable support leg assembly 14 may range to encompass any height used in tables, counters, bars, or other works stations, and more specifically may range from about eighteen inches (18") to about sixty inches (60"). However, most applications of the present invention will place work surface 12 at a height in a range from about twenty-four inches (24") to about forty inches (40") above the floor, ground, or any support surface.

Adjustable support leg assembly 14 as described above is pivotally coupled to first section 22 of work surface 12 proximate first end 26 and bottom surface 32. One embodiment includes first end 66 of first fixed leg 54 and first end 70 of second fixed leg 56 being pivotally coupled to first section 22. Adjustable support leg assembly 14 is in a fully retracted position or an extended position. The fully retracted position includes adjustable legs 60 and 62 being fully retracted with fixed legs 54 and 56 as described above, and adjustable support leg assembly pivoted into a plane substantially parallel to work surface 12. One embodiment includes the outer dimension of fixed legs 54 and 56 being less than thickness T1 and lengths $L_3$ and $L_4$ being less than length $L_1$ of first section 22 of work surface 12 to allow adjustable support leg assembly 14 to be received into and housed within first table section 22 of work surface 12 in the fully retracted position. One embodiment of the extended position of adjustable support leg assembly 14 includes adjustable support leg assembly 14 being pivoted in a plane perpendicular to work surface 12 and extending outwardly from bottom surface 32. Second ends 80 and 84 of adjustable legs 60 and 62 further extend an appreciable distance from second end 68 and 72 of fixed legs 54 and 56 as shown in FIGS. 1 and 2 to provide an overall height as described above.

Figure 3:
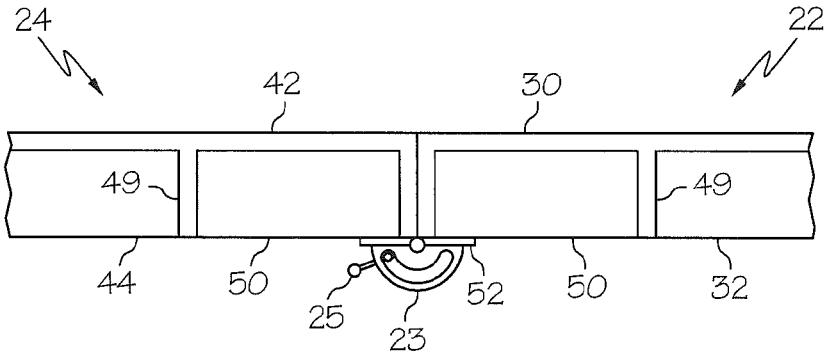
FIG. 3 is a cross-sectional view along line 3-3 of one embodiment of the connection between two panels of the embodiment of the universal workstation of FIG. 1 in accordance with the teachings of the present invention.

As illustrated in FIG. 3, an alternative embodiment of the work surface 12 of the present invention includes first section 22 and second section 24 being a unitary piece of molded polymeric material. Table sections 22 and 24 may further include integral horizontal support ribs 49 that span substantially from side to side and longitudinal support ribs 50 that span substantially from end to end. These support ribs 49 and 50 extend downwardly from bottom surface and may terminate at a common plane. Further, recessed portions may be molded into the bottom surfaces 32 and 44 of table sections 22 and 24 and configured to receive adjustable support leg 14 in a retracted and folded position.

FIG. 3 further shows first section 22 and second section 24 being pivotally coupled together using pivoting mechanism 52. An embodiment of portable workstation 10 includes pivoting mechanism 52 being separable such that first section 22 may be selectively separated from second section 24. One embodiment includes pivoting mechanism 52 being at least one hinge coupled to bottom surface 32 of first section 22 and bottom surface 44 of second section 24 as shown in FIG. 3. Pivot mechanism 52 may be a piece of flexible and resilient material, spring loaded hinge, locking hinge mechanism or other hinge device now known or hereafter developed that is coupled to each table section 22 and 24 to operably connect table sections 22 and 24. Further, pivot mechanism may temporarily fix itself when first table section 22 and second table section 24 are in an open (in use) position. The locking pivot mechanism 23 may further include a release mechanism 25, such as push button, spring loaded, or other release mechanism now known or hereafter developed to allow the two table sections 22 and 24 to be folded up for transport or storage.

Figure 4:
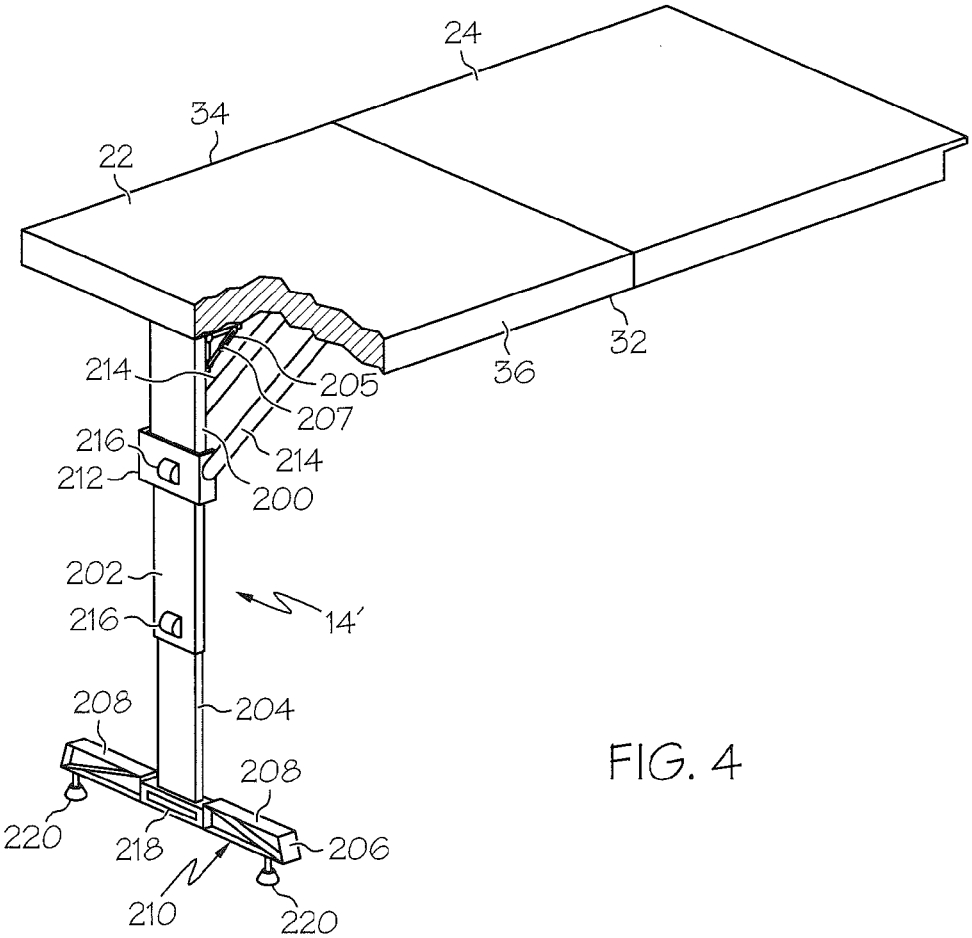
FIG. 4 is a perspective view of another embodiment of the adjustable leg assembly in accordance with the teachings of the present invention.

FIG. 4 illustrates another embodiment of adjustable support assembly 14' having a single leg assembly comprising a first tubular section 200, a second tubular section 202 slideably coupled with first tubular section 200, a third tubular section 204 slideably coupled with second tubular section 202, and a base 206. One embodiment includes the three tubular sections 200, 202, and 204 being substantially rectangular. Second tubular section 202 is configured to be received by first tubular section 200 and third tubular section 204 is similarly configured to be received by second tubular section 202 such that all three pieces interact to provide a telescoping extension or retraction of adjustable support assembly 14' as shown. Base 206 is coupled to third tubular section 204 and provides one or more points of support for portable workstation 10. Third tubular section 204 is coupled to base 206 in the middle third of its length, but third tubular section 204 being coupled any where along the length of base 206 is within the scope of the present invention. Base 206 may include two low profile feet 208 with a link support 210 connecting two feet 208 together as shown. Feet 208 may further include one or more threaded levelers 220 that are operably connected to feet 208 such that they may be rotated relative to feet 208 to fine tune the height and level work surface 12 of portable workstation 10. Threaded levelers 220 may be threaded screws that have a non-abrasive and/or not marking finish such that they will not indent or mark the supporting surface.

First tubular section 200 is pivotally coupled to work surface 12, with one embodiment including first tubular section 200 being coupled to bottom surface 32 of first table section 22 of work surface 12. The pivot coupling of first tubular section 204 to bottom surface 32 of first table section 22 may further include a locking mechanism 205 that locks first tubular section 204 in its extended position until a release mechanism is activated to allow a retracted adjustable support assembly 14' received within first tubular section 204 to be pivoted and retracted into a housing in first table section 22 configured to receive adjustable support assembly 14'. Any such locking and release mechanisms now known or hereafter developed are within the scope of the present invention.

As further illustrated in FIG. 4, one embodiment of the present invention includes adjustable support assembly 14', which also includes a sleeve 212 having similar dimensions and cross section as first tubular section 200. Sleeve 212 is configured to slide along a substantial portion of second tubular section 202. Brace bars 214 are pivotally coupled to sleeve 212 and to sides 34 and 36 as shown. Brace bars 214 prevent adjustable support assembly 14' from pivoting past a certain angle with respect to work surface 12 when adjustable support assembly 14' is in a fully extended position. Adjustable support assembly 14' will be substantially vertical in orientation, and/or substantially perpendicular to work surface 12 in an extended configuration. When adjustable support assembly 14' is retracted and pivoted toward bottom surface 32 of work surface 12, sleeve 212 slides along first tubular support section 200. Sleeve 212 also prevents sideways displacement of workstation with respect to adjustable support assembly 14' in both the extended. A locking mechanism (not shown) may be incorporated into sleeve 212 to prevent it from sliding relative to first tubular section 200. The total height of this embodiment will have the same ranges listed above, but will be the sum of the lengths of three sections as shown herein. An embodiment of adjustable support assembly of the present invention may also be a combination of the embodiments described herein.

As further seen in FIG. 4, an embodiment of height adjustment lock 216 may include one or more one-way ratcheting mechanisms that allow for the height to be increased until a desired height and locked into place at the desired height. When a user wants to collapse and stow the device, a spring loaded release bar 218 or the like will be pressed as to release the one-way ratcheting mechanism of leg sections 202 and/or 204, thereby allowing third tubular section 204 to telescope back into second tubular section 202 and second tubular support section 202 to telescope back into first tubular section 200 to allow adjustable support leg 14 to be in a retracted position and pivoted into a housing within table section 22 as described herein. The lock release may alternatively be a pull strap, button, toggle or any other release mechanism now known or hereafter developed.

Figure 5:
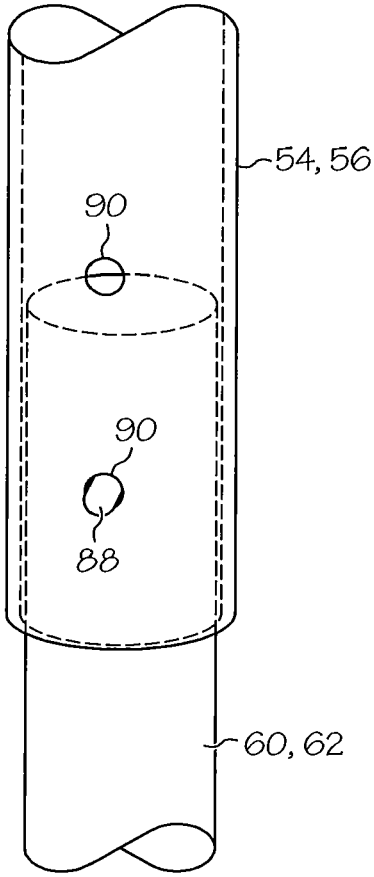
FIG. 5 is a side view of one embodiment of height adjustment lock in accordance with the teachings of the present invention.

FIG. 5 illustrates one embodiment of the present invention wherein adjustable leg 60, 62 is received into fixed leg 54, 56 and the position of adjustable leg 60, 62 is temporarily fixed with respect to fixed leg 54, 56 through height adjustment lock 64. In particular, FIG. 5 illustrates an embodiment of height adjustment lock 64 being a spring mounted pin 88 that engages one of a plurality of holes 90 in fixed leg 54, 56 along its length. The holes may be spaced at a common interval, such as one-half inch (½"), to allow adjustable leg 60 or 62 to be extended or shortened to provide the desired overall height. Any known hole spacing interval is within the scope of the present invention. A spring mounted pin and hole mechanism may be readily modified for use with the adjustable support assembly illustrated in FIG. 4.

Figure 6:
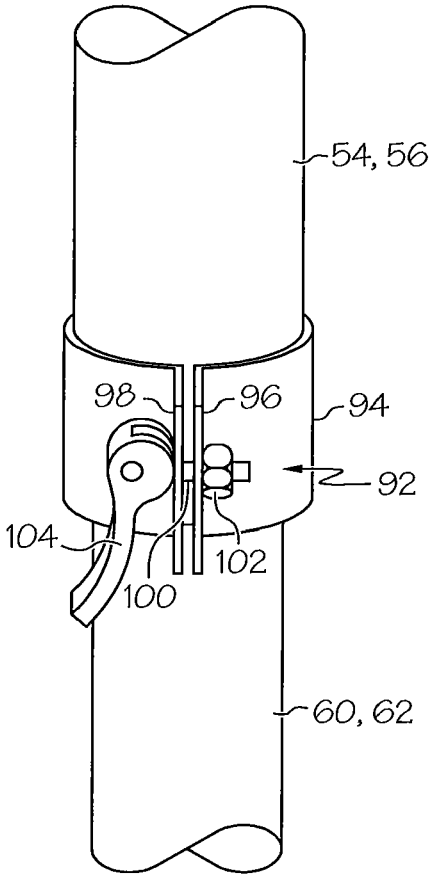
FIG. 6 is a side view of one embodiment of height adjustment lock in accordance with the teachings of the present invention.

FIG. 6 illustrates an alternative embodiment of height adjustment lock 64 comprising a clamp 92 including a flanged collar 94 including a first flange 96 and a second flange 98, a pin 100 passing through both flanges 96 and 98 and including a head or nut 102 at one end to prevent pin 100 from being pulled through flange 96, and a lever 104 at another end engaging flange 98. Lever 104 may include a cam-action as shown to provide the clamping force necessary to temporarily fix adjustable leg 60 or 62 with respect to fixed leg 54 or 56. The present invention should not be limited to the clamp as shown and clamp 92 may be any clamping mechanism now known or hereafter developed. Notwithstanding the embodiments shown, height adjustment mechanism may be any mechanical method of removably coupling adjustable legs 60 and 62 with respect to fixed legs 54 and 56 and fixing the position of an adjustable leg to a fixed leg.

The clamping mechanism shown in FIG. 6 allows a user to more exactly adjust the combined length of first fixed leg 54 and first adjustable leg 60 and/or second fixed leg 56 and first adjustable leg 62 in the case that the floor, ground, or support surface is uneven requiring a different height for the first legs 54, 60 and the second legs 56, 62 to ensure work surface 12 is substantially level because it is not limited to adjustment in intervals corresponding to the hole spacing of the embodiment shown in FIG. 5.

Figure 7A:
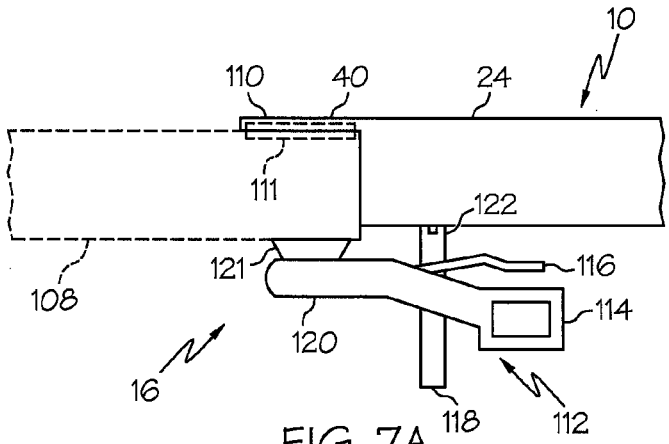
FIG. 7A is a side view of one embodiment of an attachment clamp in accordance with the teachings of the present invention.
Figure 7B:
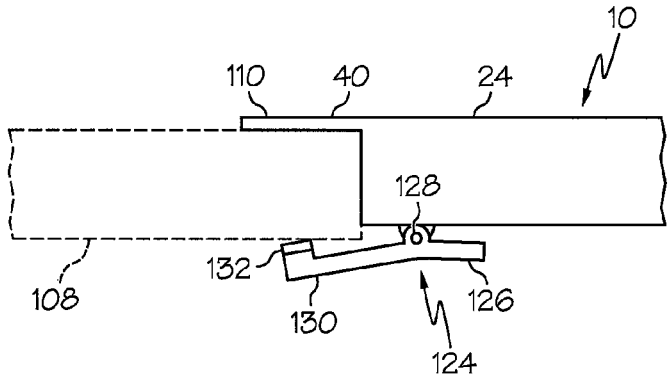
FIG. 7B is a side view of one embodiment of an attachment clamp in accordance with the teachings of the present invention.
Figure 7C:
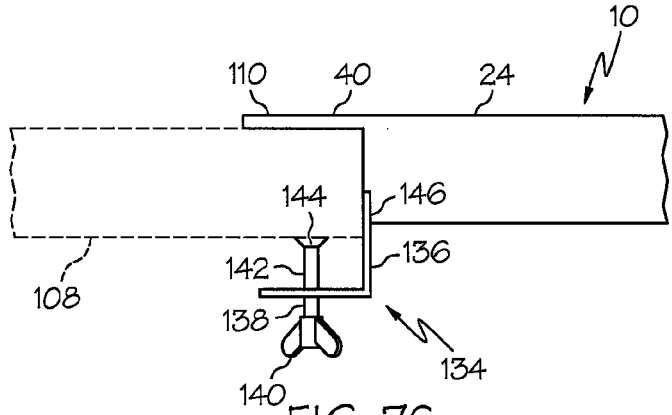
FIG. 7C is a side view of another embodiment of an attachment clamp in accordance with the teachings of the present invention.

Now turning to FIGS. 7A, 7B, and 7C illustrating three possible embodiments of attachment clamp 16 that secures portable workstation 10 of the present invention to an existing work surface 108. Attachment clamp 16 secures second end 40 of second table section 24 to existing work surface 108. Attachment clamp 16 may include one or more hooks, straps, elastic cords, clamps, hook and loop fastener (VELCRO®), or any combination thereof or any other attachment methods now known or hereafter developed. As seen in 7A, 7B, and 7C, there is a notched portion of second end 40 of second table section 24 that fits over the edge of existing work surface 108 as shown. The overlapping portion 110 of second end 40 overlaps and rests upon the edge of existing work surface 108 and keeps second end 40 from downward displacement due to gravity. The underside of overlapping portion 110, which is in contact with work surface 108, may include one or more anti-slip features 111. For example, one or more pads, nibs or projections of rubber, neoprene, a viscoelastic material, soft polyethylene, or other composite material that increases the friction between overlapping portion 110 and work surface 108 when engaged. Attachment clamp 16 then clamps the edge of existing work surface 108 against the notched second end 40 of second table section 24 to resist lateral and horizontal displacement of portable workstation 10 while in use. Attachment clamp 16 is configured to be able to secure portable workstation 10 to a surface from about one-eighth inch (⅛") thick to about six inches (6") thick. Further, attachment clamp may also include one or more draw-tight, tie-back, ratchet or other similar straps as now known or hereafter developed to secure portable workstation 10 to elements over six inches (6") thick.

FIG. 7A illustrates an embodiment wherein attachment clamp 16 comprises a ratchet bar clamp 112 pivotally coupled to work surface 12. Ratchet bar clamp 112 comprises a handle 114, a ratchet arm 116, a guide bar 118, a ratcheting mechanism (not shown), and a clamping arm 120. Ratchet bar clamp 112 may further include a clamp pad 121 that is compressible, for example, rubber, neoprene, a viscoelastic material, soft polyethylene, or other composite material, such that ratchet bar clamp 112 does not damage existing work surface 108 when securing portable workstation 10 thereto. Guide bar 118 may include one or more holes proximate the end furthest away from work surface 108 so that utensils or other items may be hung from guide bar 118 when the clamp is engaged. When not in use, bar clamp 112 may be pivoted about a pivot point 122 such that guide bar 118 is parallel to work surface 12. Bar clamp 112 may be received into bottom surface 44 of second table section 24 or, alternatively, bottom surface 32 of first table section 22 may be configured to receive ratchet bar clamp 112 so that when portable workstation 10 is folded up, bottom surfaces 32 and 44 lie substantially parallel for compact transportation or storage.

FIG. 7B illustrates an embodiment wherein attachment clamp 16 comprises a spring loaded pivot clamp 124 coupled to bottom surface 44 of second table section 24 of work surface 12. Pivot clamp 124 comprises a handle 126, a pivot point 128, a spring (not shown), and a clamping arm 130. Pivot clamp 124 may further include a clamp pad 132 that is compressible, for example, rubber, neoprene, a viscoelastic material, soft polyethylene, or other composite material, such that ratchet bar clamp does not damage existing work surface 108 when securing portable workstation 10 to it. Bottom surface 32 of first table section 22 may be configured to receive pivot clamp 124 when portable workstation 10 is folded up to allow bottom surfaces 32 and 44 to lie substantially parallel for compact transportation or storage.

FIG. 7C illustrates an embodiment wherein attachment clamp 16 comprises a screw-type clamp 134 pivotally coupled to bottom surface 44 of second table section 24 of work surface 12. Screw-type clamp 134 may comprise an L-shaped bracket or other bracket configured for such clamp 136 and a screw 138 having a twisting head 140, a threaded body 142 and a bearing head 144. Screw-type clamp 134 may be connected to workstation 10 by a hinge 146. Screw 138 may be advanced or reversed by applying torque to twisting head 140 such that bearing head 144 bears against a bottom of the existing work surface 108. Twisting head 140 may be any handle shape now known or hereafter developed configured for manually applying torque to a screw. For example, a butterfly as shown in FIG. 7C or a textured grip may be used. Torque may continue to be applied to twisting head 140 until screw 138 may no longer advances or at some point just prior to that. Screw-type clamp 134 may further include a clamp pad (not shown) on the face of bearing head 144 that is compressible, for example, rubber, neoprene, a viscoelastic material, soft polyethylene, or other composite material, such that ratchet bar clamp does not damage existing work surface 108 when securing portable workstation 10 to it. Screw-type clamp 134 is configured to be hidden during storage and transport. One embodiment includes the L-bracket being pivoted to nest within the notch in second end 40 of second table section 24. Another embodiment includes rotating the L-bracket back toward hinge 52 wherein bottom surface 32 or 44 of table section 22 or 24 may be configured to receive screw-type clamp 132 when portable workstation 10 is folded up to allow bottom surfaces 32 and 44 to lie substantially parallel for compact transportation or storage.

Figure 8:
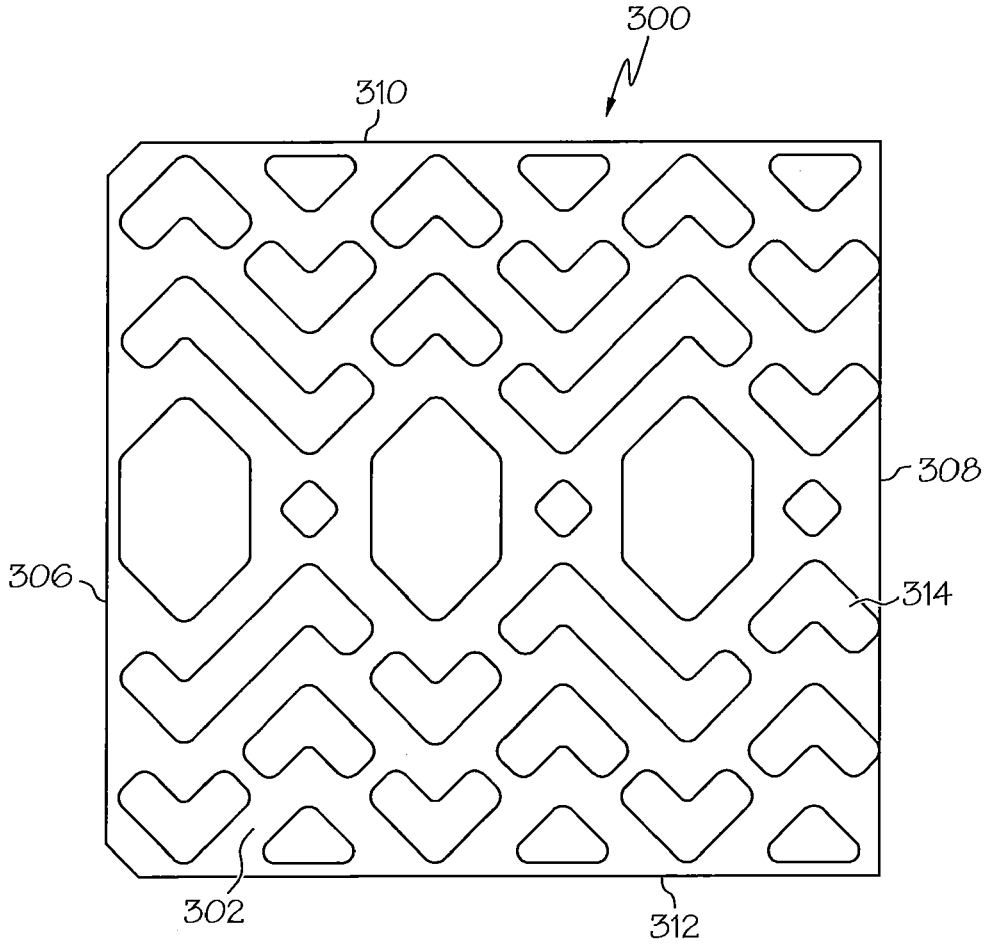
FIG. 8 is a bottom view of one embodiment of a table section in accordance with the teachings of the present invention.

FIG. 8 illustrates another embodiment of portable workstation 10 including first table section 22 and second table section 24 (shown in FIG. 2) each being a substantially similar blow-molded plastic top section 300. Each blow-molded plastic top section 300 includes a top surface 302, a bottom surface 304, a front edge 306, a back edge 308, a first side edge 310 and a second side edge 312. Top surface 302 is substantially planar. Bottom surface 304 may include a plurality of protuberances or depressions 314 in random shapes distributed randomly about bottom surface 304 to help reinforce the bottom surface 304 and/or strengthen the entire table section 300. Alternatively, bottom surface 304 may include a plurality of horizontal ribs (not shown), longitudinal ribs (not shown), or a combination thereof either inwardly or outwardly disposed to reinforce bottom surface 304 and/or strengthen the entire table section 300. In the embodiment including ribs or depressions inwardly disposed, the ribs or depressions may extend to and be coupled with top surface 302. This configuration may also strengthen the overall table top section 300.

Figure 9:
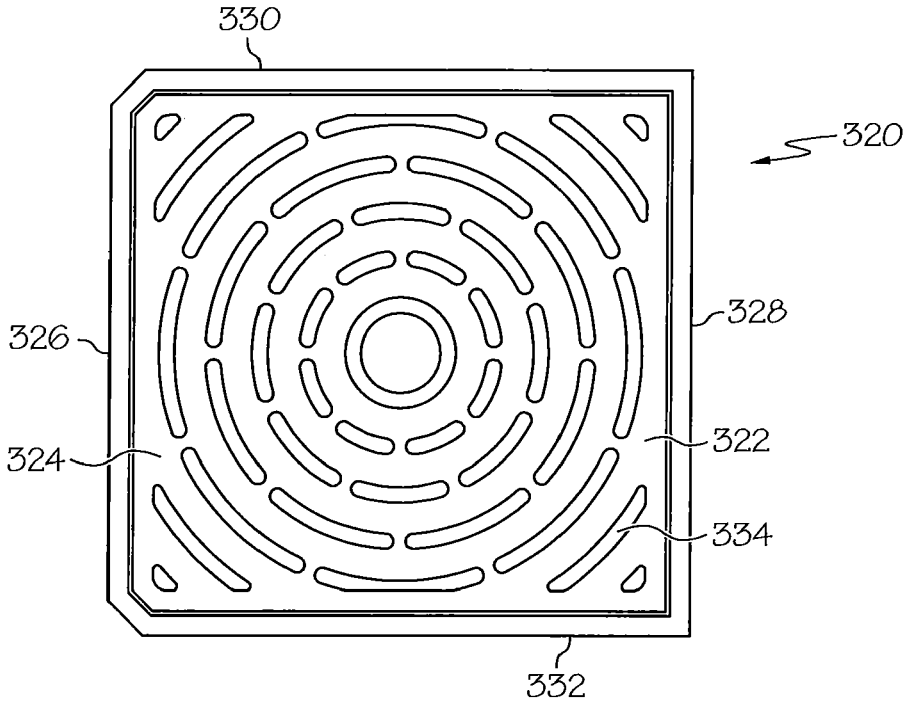
FIG. 9 is a bottom view of another embodiment of a table section in accordance with the teachings of the present invention.
Figure 10:
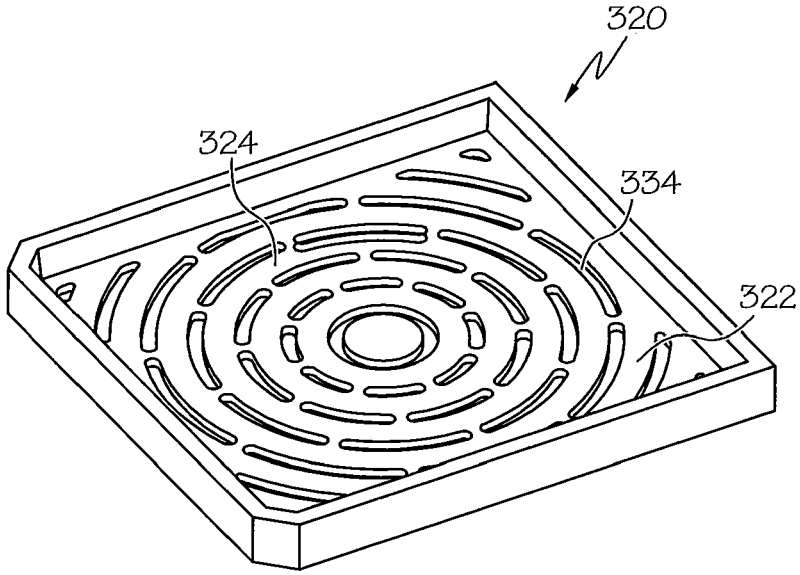
FIG. 10 is a perspective view of the table section of FIG. 9.

FIGS. 9 and 10 illustrates yet another embodiment of portable workstation 10 including first table section 22 and second table section 24 (each shown in FIG. 2) each being a substantially similar blow-molded plastic top section 320. Each blow-molded plastic top section 320 includes a top surface 322, a bottom surface 324, a front edge 326, a back edge 328, a first side edge 330 and a second side edge 332. Top surface 322 is substantially planar. Bottom surface 324 may include a plurality of protuberances or depressions 334 in a circular pattern distributed about bottom surface 324 to help reinforce bottom surface 324 and/or strengthen the entire table section 320.

From the foregoing, it may be seen that the portable workstation of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

I claim:

1. A universal portable workstation that can be temporarily coupled to an existing fixture comprising:

an adjustable support leg assembly having at least one fixed leg and at least one adjustable leg slidably coupled to said fixed leg and configured for telescopic movement therewith, and a base coupled to said adjustable leg configured to engage a support surface wherein at least one height adjustment lock operates to temporally fixedly connect said adjustable leg and said fixed leg to prevent further slidable movement therebetween;

a first table section having a top, a bottom, a first end and a second end wherein said adjustable support leg assembly is pivotally coupled to said bottom of said first table section proximate said first end and being movable between a fully extended position wherein said adjustable support leg assembly is substantially perpendicular to said first table section and a fully retracted position wherein said adjustable support leg assembly lies adjacent the bottom of said first table section;

a second table section having a top, a bottom, a first end and a second end wherein said bottom of said second end of said first table section is pivotally coupled to said bottom of said first end of said second table section, wherein said top of said second table section at said second end includes an overlapping portion having a first thickness, wherein said overlapping portion extends substantially parallel to said top and is configured to overlap and rest upon an existing fixture;

an attachment clamp operable to fixedly couple and clamp said overlapping portion of said second end of said second table section directly to and against an existing fixture said attachment clamp operable to resist lateral and horizontal displacement of said portable workstation; and a sleeve operable to slide along at least a portion of said at least one fixed leg, at least one brace bar pivotally coupled to said sleeve and to said first table section, said at least one brace bar preventing said adjustable support leg assembly from pivoting past a predetermined angle with respect to the top of said first table section when said adjustable support leg assembly is in its fully extended position.

2. The universal portable workstation of claim 1 wherein said attachment clamp is selected from a group consisting of a bar clamp, screw clamp, and pivot clamp.

3. The universal portable workstation of claim 1 wherein said fixed leg is pivotally coupled to said bottom of said first table section with a locking hinge mechanism.

4. The universal portable workstation of claim 3 wherein said locking hinge mechanism further comprises a release mechanism.

5. The universal portable workstation of claim 1 wherein said first table section is pivotally coupled to said second table section with a locking hinge mechanism.

6. The universal portable workstation of claim 5 wherein said locking hinge mechanism further comprises a release mechanism.

7. The universal portable workstation of claim 1 wherein said fixed leg comprises a plurality of nestable tubular legs.

8. The universal portable workstation of claim 1 wherein said base comprises at least two adjustable feet.

9. The universal portable workstation of claim 8 wherein said adjustable feet are threaded levelers.

10. The universal portable workstation of claim 1 including a release mechanism associated with said at least one height adjustment lock for releasing the engagement between said adjustable leg and said fixed leg.

11. The universal portable workstation of claim 1 wherein said overlapping portion further includes an anti-slip feature disposed to an underside of said overlapping portion between said overlapping portions and said existing fixture.

12. A universal portable workstation that can be temporarily coupled to an existing fixture comprising:

an adjustable support leg assembly including a fixed leg, a first adjustable leg slidably coupled to said fixed leg and configured for relative telescopic movement therewith, a second adjustable leg slidably coupled to said first adjustable leg and configured for relative telescopic movement therewith, and a base coupled to said second adjustable leg and configured to engage a support surface wherein a first height adjustment lock operates to temporally fixedly connect said first adjustable leg and said fixed leg to prevent further slidable movement therebetween and further wherein a second height adjustment lock operates to temporally fixedly connect said first adjustable leg and said second adjustable leg to prevent further slidable movement therebetween;

a first table section having a top, a bottom, a first end and a second end wherein said fixed leg of said adjustable support leg assembly is pivotally coupled to said bottom of said first table section proximate said first end and is movable between an extended position wherein said fixed leg is substantially perpendicular to said first table section and a retracted position, said bottom of said first table section is configured to house said adjustable height leg assembly in its retracted position;

a second table section having a top, a bottom, a first end and a second end wherein said bottom of said second end of said first table section is pivotally coupled to said bottom of said first end of said second table section with a locking hinge mechanism, wherein said second end of said second table section includes an overlapping portion having a first thickness wherein said overlapping portion extends parallel to said top and is configured to overlap and rest upon an existing fixture, said overlapping portion further comprising an anti-slip feature disposed to an underside of said overlapping position between said overlapping portion and said existing fixture;

at least one clamp pivotally coupled to said bottom of said second end of said second table section operable to temporally fixedly couple and clamp said overlapping portion of said second end of said second table section directly to and against an existing fixture, said attachment clamp and said anti-slip feature operable to resist lateral and horizontal displacement of said portable workstation; and a sleeve operable to slide along at least a portion of said at least one fixed leg, a pair of brace bars pivotally coupled to said sleeve and to said first table section, said pair of brace bars preventing said adjustable support leg assembly from pivoting past a predetermined angle with respect to the top of said first table section when said adjustable support leg assembly is in its extended position.

13. The universal portable workstation of claim 12 wherein said clamp is selected from a group consisting of a bar clamp, screw clamp, and pivot clamp.

14. The universal portable workstation of claim 12 wherein said fixed leg comprises a plurality of nestable tubular legs.

15. The universal portable workstation of claim 12 wherein said base comprises at least two adjustable feet.

16. The universal portable workstation of claim 15 wherein said adjustable feet are threaded levelers.

17. The universal portable workstation of claim 12 including a release mechanism associated with said first and second height adjustment locks for releasing the engagement between said first adjustable leg and said fixed leg and between said second adjustable leg and said first adjustable leg.

18. The universal portable workstation of claim 12 wherein the bottom of at least one of said first and second table sections includes a plurality of protuberances distributed over the bottom thereof.

19. The universal portable workstation of claim 18 wherein said plurality of protuberances are distributed in a circular pattern over the bottom thereof.

* * * * *